United States Patent [19]

Poblete

[11] 4,220,524

[45] Sep. 2, 1980

[54] COLLECTOR AGENT FOR THE RECOVERY OF METAL VALUES IN SULPHIDE ORES BY FROTH FLOTATION

[75] Inventor: Raul Poblete, Santiago, Chile

[73] Assignee: Codelco-Chile, Santiago, Chile

[21] Appl. No.: 869,050

[22] Filed: Jan. 13, 1978

[51] Int. Cl.[2] ..... B03D 1/02

[52] U.S. Cl. ..... 209/166; 252/61

[58] Field of Search ..... 209/166, 167; 252/61, 252/307; 260/455

[56] References Cited

U.S. PATENT DOCUMENTS

| | | | |
|---|---|---|---|
| 1,236,857 | 8/1917 | Martin | 209/166 |
| 1,652,099 | 12/1927 | Douglass | 209/166 |
| 1,684,536 | 9/1928 | Fisher | 209/166 |
| 1,816,145 | 7/1931 | Douglass | 209/166 |
| 2,320,287 | 5/1943 | Lieber | 260/455 B X |
| 2,412,500 | 12/1946 | Fischer | 209/166 |
| 2,431,010 | 11/1947 | Zimmer | 260/455 B X |

FOREIGN PATENT DOCUMENTS

| | | | |
|---|---|---|---|
| 2337199 | 7/1977 | France | 209/166 |
| 322527 | 12/1929 | United Kingdom | 209/166 |

OTHER PUBLICATIONS

Chem Abst., 68, 1968, 14973K.

*Primary Examiner*—Robert Halper
*Attorney, Agent, or Firm*—Pennie and Edmonds

[57] ABSTRACT

A collector agent for use in froth flotation processes to recover metal values of sulphide ores is disclosed which agent comprises the reaction product resulting from mixing and reacting in the presence of visible light, heat, or both, a mixture of:

(i) a mixture of hydrocarbons having from 5 to 10 (inclusive) carbon atoms,
(ii) methyl isobutyl carbinol (MIBC),
(iii) ethyl xanthyl ethylformic ester (EEF), and
(iv) elemental sulphur (S).

6 Claims, No Drawings

COLLECTOR AGENT FOR THE RECOVERY OF METAL VALUES IN SULPHIDE ORES BY FROTH FLOTATION

PRIOR ART

The use of ethyl xanthyl ethylformic ester (EEF) as a collecting agent in the froth flotation method of recovering metal values of sulphide ores is known. Such processes commonly use a frothing agent or "frother" and may also use a modifier such as sulphuric acid or calcium hydroxide.

BRIEF DESCRIPTION OF THE INVENTION

In the present invention the collector agent comprises the reaction product of a mixture of:

(i) a mixture of aliphatic, napthenic, and aromatic hydrocarbons having from 5 to 10 (inclusive) carbon atoms, (ii) methyl isobutyl carbinol (MIBC), (iii) ethyl xanthyl ethylformic ester (EEF), and (iv) elemental sulfur (S).

The reaction is carried out in the presence of visible light, heat, or both. The proportions may vary within the following limits:

| | |
|---|---|
| gasoline | 20% to 45% by weight |
| MIBC | 5% to 15% by weight |
| EEF | 50% to 75% by weight |
| S | 0% to 2% by weight |

and preferably within the following ranges:

| | |
|---|---|
| gasoline | 20% to 40% by weight |
| MIBC | 5% to 10% by weight |
| EEF | 50% to 70% by weight |
| S | 0% to 2% by weight |

When this mixture reacts, a green colored reagent is produced, which turns into a dark brown compound when exposed to light or heat, with improvement in its collecting properties. The mixture shows a low flash point requiring the use of suitable safety precautions as will be apparent to those skilled in the art.

The chemical formulas of the compounds of this collector agent are:

Mixture of hydrocarbons with not less than five nor more than ten carbon atoms:

This is a commercially available product named gasoline and tends to vary somewhat. However, generally it has the following makeup:

(a) 48% by weight of aliphatic hydrocarbons, including oleffins (10%) and paraffins (38%). Specifically, by weight:

3%—$C_6H_{12}$
3%—$C_7H_{14}$
4%—$C_8H_{16}$
18%—$C_5H_{12}$
10%—$C_6H_{14}$
10%—$C_7H_{16}$ (b) 20% by weight of naphthenic hydrocarbons
20%—$C_7H_{14}$ (c) 30% by weight of aromatic hydrocarbons
15% toluene—$C_7H_8$
10% orthoxylene—$C_8H_{10}$ 5% methaxylene—$C_8H_{10}$ (d) 2% by weight of N, O, S and other.

| | |
|---|---|
| MIBC: | $CH_3-CHOH-CH_2-\underset{\underset{CH_3}{\vert}}{CH}-CH_3$ |
| EEF: | mixture of: |
| | Diethyl xanthogenformiate |
| | $C_2H_5O-\underset{\underset{S}{\Vert}}{C}-S-\underset{\underset{O}{\Vert}}{C}-O\ C_2H_5$, |
| | Diethyl xanthic oxide |
| | $C_2H_5O-\underset{\underset{S}{\Vert}}{C}-S-\underset{\underset{S}{\Vert}}{C}-O\ C_2H_5$, |
| | Ethyl Alcohol |
| | $C_2H_5OH$ |
| Sulphur: | S° |

The collector of this invention works efficiently in a flotation circuit of acid pH or with a natural water-mineral pH less than 7, and is particularly suited for the froth flotation of metallic ores comprising metallic sulphides such as:

Ores containing copper and iron such as:

| | |
|---|---|
| Chalcopyrite | ($CuFeS_2$) |
| Chalcocite | ($Cu_2S$) |
| Covelline | ($CuS$) |
| Bornite | ($Cu_5FeS_4$) |
| Tennantite | ($Cu_{12}AS_4S_{13}$) |
| Tetrahedrite | ($Cu_{12}Sb_4S_{13}$) |
| Pyrite | ($FeS_2$) |
| Enargite | ($Cu_3AS\ S_4$) |

Ores containing zinc, such as:
Sphalerite—($ZnS$)

Ores containing lead, such as:
Galena—($PbS$)

Ores containing silver, such as:

| | |
|---|---|
| Argentite | ($Ag_2S$) |
| Stephanite | ($Ag_5Sb\ S_4$) |
| Pyrargyrite | ($Ag_3Sb\ S_3$) |

Ores containing platinum, such as:
Cooperite—$Pt(AsS)_2$

The collector agent is also suitable for the froth flotation of metallic ores of copper sulphide containing also low amounts of copper oxide such as:

| | |
|---|---|
| Cuprite | ($Cu_2O$) |
| Brochantite | ($Cu_4(SO_4)(OH)_6$) |
| Malachite | ($CU_2(OH)_2CO_3$) |
| Chrysocolla | ($CuSiO_3-2\ H_2O$) |

Metallic ores of copper sulphide which also contain molybdenite ($MoS_2$) can also be treated successfully.

Sulphide ores of cobalt, nickel, tin and other metallic sulphides can also be processed with the collector of this invention.

In the selective flotation of one or more of copper, iron, or molybdenum ores, the collector can be added in the grinding stage at rates of about 70 grams per metric ton (g/TM) for head grades varying between 1.40 and 1.60% copper, with a corresponding increase or decrease in rate as indicated by variations in the head grade of the useful element.

Flotation with the collector of this invention includes the use of a frothing reagent which is added independently, either in the grinding stage or in conditioner tanks or boxes ahead of the flotation stage, but does not include necessarily the use of a modifier such as sulfuric acid or calcium hydroxide.

It has been found that the collector agent of this invention has better solubility in water than EEF, and that it has the further advantage of lower cost by approximately 30% with respect to the standard reagent EEF.

Further, the collector agent of this invention improves its selectivity and efficiency in the stages following flotation such as up-grading, cleaning and recleaning of concentrates and does not require the use of secondary collectors or accelerators.

DETAILED DESCRIPTION OF THE INVENTION

Preparation of the Reagent

The reagent of this invention is prepared by adding the mixture of hydrocarbons to the EEF and agitating the same. After agitation the MIBC is added to the mixture and the mixture is again agitated. After the second agitation the mixture is left to settle in the presence of light. The time for agitation and settling needed to complete the reaction is variable depending upon the amount of reagent being prepared but the time is not proportional necessarily to the quantity of reagent and depends in part upon the reactor equipment used. The following times are illustrative.

(A) For a laboratory preparation (For example 2,000 cc):

| | |
|---|---|
| 1st agitation | 5 min minimum |
| 2nd agitation | 5 min minimum |
| settling time | 20 min minimum |
| Total reaction time | 30 min minimum |

(B) For a Full Plant preparation with amounts up to 100,000 liters:

| | |
|---|---|
| 1st agitation | 15 min minimum |
| 2nd agitation | 15 min minimum |
| settling time | 60 min minimum |
| Total reaction time | 90 min minimum |

The preparation temperature used in preparing a reagent for the following examples was 15° C.; however, a range of about 4° C. to about 20° C. is satisfactory.

The preferred quantities of the ingredients in this mixture are as follows:

| | |
|---|---|
| Mixture of hydrocarbon | 30% by weight |
| MIBC | 10% by weight |
| EEF | 60% by weight |
| S | 0% |

More specifically, the best known proportions for the ingredients of this reagent are as follows:

| | |
|---|---|
| Mixture of hydrocarbons | 30.00% by weight |

-continued

| | |
|---|---|
| MIBC | 10.00% by weight |
| Diethyl xanthogenformiate | 46.20% by weight |
| Diethyl xanthic oxide | 7.62% by weight |
| Ethyl alcohol | 3.00% by weight |
| Others | 3.18% by weight |

In the examples below the specific quantities of ingredients used in each example are set forth therein. The preparation procedure followed was that set forth above under "Preparation of the Reagent" and the specific chemical makeup of the ingredients was as follows:

I. The mixture of hydrocarbons* had the following makeup:

*identified as "common gasoline," 81 octanes, produced by ENAP-Chile, sold by COPEC-Chile (address: 2300 Jorge Montt St. Vina Del Mar Chile)

(a) 48% by weight of aliphatic hydrocarbons, including oleffins (10%) and paraffins (38%). Specifically, 3% $C_6H_{12}$ by weight
3% $C_7H_{14}$ ''''
4% $C_8H_{16}$ ''''
18% $C_5H_{12}$ ''''
10% $C_6H_{14}$ ''''
10% $C_7H_{16}$ ''''

(b) 20% by weight of naphthenic hydrocarbons
20% $C_7H_{14}$ (c) 30% by weight of aromatic hydrocarbons
15% toluene—$C_7H_8$
10% orthoxylene—$C_8H_{10}$
5% methaxylene—$C_8H_{10}$ (d) 2% by weight of N, O, S and other.

II. The EEF ingredient had the following components:

| | |
|---|---|
| Diethyl xanthogenformiate $CH_3CH_2-O-\overset{\overset{S}{\|}}{C}-S-\overset{\overset{O}{\|}}{C}-O-CH_2CH_3$ | 77.0% by weight |
| Diethyl xanthic oxide $CH_3CH_2-O-\overset{\overset{S}{\|}}{C}-S-\overset{\overset{S}{\|}}{C}-O-CH_2CH_3$ | 12.7% by weight |
| Ethyl alcohol $C_2H_5-OH$ | 5.0% by weight |
| other | 5.3% by weight |

III. MIBC:

| | |
|---|---|
| $CH_3-CHOH-CH_2-\underset{\underset{CH_3}{\|}}{CH}-CH_3$ | 100.0% by weight |

IV. Elemental sulfur may be added to stabilize the reagent and is, therefore, optional.

EXAMPLE #1 (Laboratory Scale)

Tests were conducted on ores coming from the Mine Teniente 1 Sur whose characteristics and ore composition are as follows:

| Minerals | % Weight |
|---|---|
| Pyrite | 4.40 |
| Chalcopyrite | 0.97 |
| Chalcocite | 0.52 |
| Covelline | 0.61 |
| Bornite | 0.19 |
| Tennantite | Tr. |

-continued

| Minerals | % Weight |
|---|---|
| Molybdenum | 0.03 |
| Gangue | 93.24 |
| % sulfide copper | 1.27 |
| % oxide copper | 0.18 |
| % total copper (head) | 1.45 |

The ore (quartz-sericite) shows considerable variation with the presence of clay of up to 4% by weight.

The ore was crushed to −10 mesh and ground wet in a ball mill at a concentration of 67% solids until a grind of 80% minus 150 mesh was obtained. Flotations at acid conditions with an initial density of 34% solids were carried out in a laboratory flotation machine (WEMCO) at 1700 rpm.

The standard collector EEF was added to the above ore in the ball mill at the rate of 70 grams per metric ton (g/TM); frother Dow-froth 1012 and sulfuric acid as modifier were used. Frother and modifier were added to the flotation cell and agitated for 30 seconds. Flotation was carried out for 7 minutes.

EXAMPLE #2 (Laboratory Scale)

The collector reagent of this invention was prepared as above described. The ingredients had the following proportions:

| | |
|---|---|
| Hydrocarbons | 0.021 grams |
| MIBC | 0.007 grams |
| EEF | 0.042 grams |
| S | 0.000 |
| Total | 0.070 grams |

The reagent was added in the ball mill to the same ore as in Example 1 instead of the standard collector EEF. The reagent was added at the rate of 70 g/TM. Other conditions were as in Example 1.

EXAMPLE #3 (Laboratory Scale)

The collector reagent of this invention was prepared as above described. The ingredients had the following proportions:

| | |
|---|---|
| Hydrocarbons | 0.015 grams |
| MIBC | 0.005 grams |
| EEF | 0.030 grams |
| S | 0.000 |
| Total | 0.050 grams |

The reagent was added in the ball mill at the rate of 50 g/TM to the same ore as in Examples 1 and 2. Other conditions were as in examples 1 and 2.

The results of Examples 1, 2, and 3 are set forth in Table I below.

TABLE I

| | | Ex. 1 | Ex. 2 | Ex. 3 |
|---|---|---|---|---|
| Heads | % total Cu | 1.380 | 1.420 | 1.404 |
| Concentrates | % total Cu | 12.70 | 17.70 | 17.90 |
| | % insoluble | 27.80 | 18.80 | 17.40 |
| Tails | % total Cu | 0.224 | 0.204 | 0.204 |
| Recovery | % total Cu | 85.29 | 86.62 | 86.47 |

The above results show that the collector reagent of this invention gives a clear advantage over the standard EEF, with a higher concentrate grade, lower insoluble content and higher copper recovery.

EXAMPLE #4 (Laboratory Scale)

This test was carried out with ores coming from the Mine Tenient Norte, whose characteristics and minerological compositions are different from those of Example #1 and are set forth below:

| Minerals | % Weight |
|---|---|
| Pyrite | 0.96 |
| Chalcopyrite | 2.11 |
| Chalcocite | 0.38 |
| Covelline | 0.56 |
| Bornite | traces |
| Tennantite | traces |
| Tetrahedrite | traces |
| Molybdenum | 0.03 |
| Gangue | 95.96 |
| % sulfide copper | 1.40 |
| % oxide copper | 0.20 |
| % total copper | 1.60 |

This ore does not contain clay and is less varied than the ore from Teniente 1 Sur. The crushing, grinding and flotation stages were as in the previous examples.

The standard collector EEF was added to the ore in the ball mill at the rate of 70 g/TM; Dow-Froth 1012 was added as a frother and sulfuric acid as modifier was also used. Frother and modifier were conditioned for 30 seconds. Flotation was carried out for 7 minutes.

EXAMPLE #5

The collector reagent of this invention prepared as above described and having the same proportions as Example #2 was added in the ball mill to the same ore as in Example #4 at the rate of 70 g/TM instead of the standard collector. Other conditions were as in Example #4.

EXAMPLE #6

The collector reagent of this invention prepared as above described and having the same proportions as Example #3 was added at the rate of 50 g/TM in the ball mill to the same ore as in Examples #4 and #5 instead of the standard collector. Other conditions were as in Examples 4 and 5.

The results of Examples 4, 5 and 6 are set forth in Table II below:

TABLE II

| | | Ex. 4 | Ex. 5 | Ex. 6 |
|---|---|---|---|---|
| Heads | % total Cu | 1.679 | 1.688 | 1.677 |
| Concentrates | % total Cu | 18.30 | 21.80 | 22.00 |
| | % insoluble | 30.40 | 24.30 | 26.00 |
| Tails | % total Cu | 0.200 | 0.192 | 0.204 |
| Recovery | % total Cu | 89.04 | 89.40 | 88.67 |

The results of Examples 4 through 6 show that the collector reagent of this invention gives better concentrate grades and less insoluble content than the standard EEF. Recoveries are higher in Example 5 and lower in Example 6 with respect to the standard, but the difference is not significant.

EXAMPLES 7 and 8 (Industrial Scale, pilot section)

The first industrial scale test was carried out in the Colon Concentrator of Codelco Chile-Division El Teniente.

One plant section, with a capacity of 4000 TM/d was fed with the collector reagent of this invention at the rate of 69 g/TM of dry ore. The proportions of the ingredients of the reagent prepared as above described were:

| | |
|---|---|
| Hydrocarbons | 20.70 grams/TM |
| MIBC | 6.90 grams/TM |
| EEF | 41.40 grams/TM |
| S | 00.00 grams/TM |
| Total | 69.00 grams/TM |

A comparison was made with one plant section of similar capacity that was fed the standard collector EEF at the rate of 84 g/TM of dry ore. In both sections similar rates of frother Dowfroth 1012 and sulfuric acid were fed. The results of Examples 7 and 8 are set forth in Table III.

TABLE III

| | | Example 7 Collector Agent of this Invention 69 g/TM | Example 8 Standard Collector EEF 84 g/TM |
|---|---|---|---|
| Head | %Cu (Total) | 1.414 | 1.393 |
| | %Cu (non-sulfur) | 0.19 | 0.18 |
| | %$MoS_2$ | 0.027 | 0.031 |
| | %Fe (Total) | 4.37 | 4.47 |
| Concentrates | %Cu (Total) | 8.11 | 8.84 |
| | %$MoS_2$ | 0.15 | 0.15 |
| | %Fe (Total) | 10.53 | 11.07 |
| | %Insol. | 45.36 | 44.40 |
| Tails | %Cu (Total) | 0.202 | 0.210 |
| | %Cu (non-sulfur) | 0.09 | 0.09 |
| | %$MoS_2$0.010 | 0.013 | |
| | %Fe (Total) | 3.13 | 3.20 |
| Recovery | %Cu (Total) | 88.01 | 87.02 |
| | %Cu (non-sulfur) | 61.42 | 56.03 |
| | %$MoS_2$ | 67.14 | 64.69 |

The results of these plant tests show advantages in recovery using the collector reagent of this invention in spite of a lower addition rate than the standard collector.

Concentrate grades do not show significant difference.

EXAMPLES 9 and 10 (Industrial scale, full plant)

The Colon Concentrator of Codelco Chile-Division El Teniente, whose rated capacity is 25,000 TM/d, was operated using as reagent the collector reagent of this invention. The reagent prepared as above described was added at the rate of 75 g/TM. The ingredients had the following proportions:

| | |
|---|---|
| Hydrocarbons | 22.50 grams/TM |
| MIBC | 7.50 grams/TM |
| EEF | 45.00 grams/TM |
| S | 0.00 grams/TM |
| Total | 75.00 grams/TM |

The plant results were compared with those obtained using the standard collector at the rate of 80 g/TM.

The results of Examples 11 and 12 are set forth in Table IV and show the effects on the final products obtained during the test runs. These results clearly indicate the advantages offered by the collector reagent of this invention because of its positive influence on selectivity in the cleaning and recleaning circuits.

TABLE IV

| | | Collector of this invention 75 g/TM | Standard collector EEF 80 g/TM |
|---|---|---|---|
| Head | % Cu (Total) | 1.58 | 1.47 |
| | % Cu (non-sulfur) | 0.19 | 0.18 |
| | % $MoS_2$ | 0.036 | 0.033 |
| Concentrate (Rougher and Upgrader) | % Cu (Total) | 24.67 | 20.95 |
| | % $MoS_2$ | 0.47 | 0.36 |
| | % Insol. | 15.28 | 19.60 |
| General Mill Tails (Rougher and Upgrader) | % Cu (Total) | 0.236 | 0.218 |
| | % $MoS_2$ | 0.012 | 0.014 |
| | % Insol. | 0.053 | 0.100 |
| Recovery (Rougher and Upgrader) | % Cu (Total) | 85.87 | 86.11 |
| Final Copper Concentrate | % Cu (Total) | 42.03 | 38.27 |
| | % $MoS_2$ | 0.20 | 0.23 |
| | % Insol. | 4.30 | 6.52 |

I claim:

1. A collector reagent for use in the froth flotation process for treating metallic ores comprising the reaction product resulting from reacting together the following ingredients:

i. gasoline, ii. methyl isobutyl carbinol, and iii. ethyl xanthyl ethylformic ester.

2. The collector agent of claim 1 in which said ingredients include elemental sulphur.

3. The collector agent of claim 2 in which said ingredients are reacted together in the following percent amounts by weight of the total ingredients:

| | |
|---|---|
| 20%–45% | gasoline |
| 5%–15% | methyl isobutyl carbinol |
| 50%–75% | ethyl xanthyl ethylformic ester |

Up to and including 2% elemental sulphur.

4. The collector reagent of claim 1 in which said ingredients are reacted together in the following percent amounts by weight of the total ingredients:

| | |
|---|---|
| 20%–45% | gasoline |
| 5%–15% | methyl isobutyl carbinol |
| 50%–75% | ethyl xanthyl ethylformic ester |

5. In the froth flotation process for treating metallic ores which process includes the treating of said ores with a collector reagent, the improvement comprising said collector reagent being the reaction product resulting from reacting together the following ingredients:

i. gasoline, ii. methyl isobutyl carbinol, and iii. ethyl xanthyl ethylformic ester.

6. The process of claim 5 in which said ingredients are reacted together in the following percent amounts by weight of the total ingredients:

| | |
|---|---|
| 20%–45% | gasoline |
| 5%–15% | methyl isobutyl carbinol |
| 50%–75% | ethyl xanthyl ethylformic ester |

* * * * *